US005641095A

United States Patent [19]

de Laforcade

[11] Patent Number: 5,641,095

[45] Date of Patent: Jun. 24, 1997

[54] AEROSOL CAN DISPENSING VALVE ACTIVATION DEVICE

[75] Inventor: Vincent de Laforcade, Clamart, France

[73] Assignee: L'Oreal, Paris, France

[21] Appl. No.: 563,236

[22] Filed: Nov. 28, 1995

[30] Foreign Application Priority Data

Nov. 29, 1994 [FR] France ..... 94 14285

[51] Int. Cl.[6] ..... B67D 5/06

[52] U.S. Cl. ..... 222/182; 222/402.13

[58] Field of Search ..... 222/182, 402.1, 222/402.13; 141/369, 380

[56] References Cited

U.S. PATENT DOCUMENTS

| | | | |
|---|---|---|---|
| 3,149,761 | 9/1964 | Harris et al. | 222/402.13 X |
| 4,277,044 | 7/1981 | Barlics | 222/402.13 X |
| 4,442,955 | 4/1984 | Bush | 222/402.13 X |
| 5,358,147 | 10/1994 | Adams et al. | 222/402.13 X |

FOREIGN PATENT DOCUMENTS

| | | |
|---|---|---|
| 2 189 278 | 1/1974 | France . |
| 2 713 953 | 6/1995 | France . |
| 2 151 327 | 5/1972 | Germany . |

*Primary Examiner*—Joseph Kaufman
*Attorney, Agent, or Firm*—Oliff & Berridge

[57] ABSTRACT

An aerosol can dispensing valve activation device includes a disk-shaped plate (1) provided with a central protuberance (2). Plate (1) is disposed transversely in a cylindrical hoop (11) attachable to an upper collar (9) of the aerosol can, and is connected at its peripheral edges to the cylindrical hoop by a connector (10), allowing displacement of plate (1) relative to hoop (11). A lever mechanism is provided having a ring (17) connected to the hoop (11) by a pivotal arm (14) having a tongue (15). An activating tab (18) projects upward from a peripheral edge of plate (1) in a location diametrically opposite tongue (15) when positioned for use.

17 Claims, 3 Drawing Sheets

AEROSOL CAN DISPENSING VALVE ACTIVATION DEVICE

BACKGROUND OF THE INVENTION

1. Field of the Invention

The present invention relates to a device for activating the dispensing valve of an aerosol can, and more specifically a device for ensuring displacement of the hollow operating rod of a dispensing valve of an aerosol can for all possible positions of the can.

2. Description of Related Art

For metered dispensing of numerous products packed in aerosols, particularly cosmetic products, it is desirable to be able to activate the aerosol can valve whether it is in the upright position in which the operating rod of the dispensing valve is inclined or vertical and pointing upward, or in the inverted position wherein the operating rod of the dispensing valve is inclined or vertical, pointing downward.

Such a dual utilization possibility for an aerosol can exists particularly in the case where the aerosol can is called upon to contain a dye intended to be mixed with an oxidizer just before use forming a dye product to be applied to the hair.

The dye and the oxidizer can be mixed just before use and protected from the air in a closed mixing container fitted with application means, as described for example in French Patent Application No. 93 15442 to the same assignee as the present invention, or more conventionally in a mixing bowl from which the dye product is applied to the hair by a separate application means.

In the case where a closed mixing container is used, as described in the aforementioned patent application, the dye contained in an aerosol can is introduced upward into the mixing container through an opening located in the bottom of the mixing container and fitted with a valve, particularly of the automatically closing membrane type.

The aerosol can is fitted for this purpose with a nozzle able to cooperate with the bottom wall of the mixing container to cause activation of the operating rod of the aerosol can dispensing valve.

The nozzle consists of a disk-shaped plate provided with a central protuberance in the shape of a dome having an internal cylindrical axial duct terminating in an outlet orifice at an upper part of the protuberance, and an internal cavity communicating with the duct and having at least one release support arranged such that, when a hollow operating rod of an aerosol can dispensing valve is introduced into the cylindrical duct, the release support constitutes a stop allowing relative displacement of the operating rod with respect to the body of the aerosol can upon depression of the disk-shaped plate and expulsion of the product contained in the aerosol can through the outlet orifice.

Thus, it is possible to ensure dispensing of the product contained in the aerosol can, when the latter is in the upright position, with activation of the aerosol can valve operating rod taking place following a relative axial movement of the aerosol can and the container provided at its base with a filling opening.

Numerous users wish to be able to prepare dyeing products with the aid of a dye contained in an aerosol can, using either a closed mixing container or a traditional open bowl. Prior connecting nozzles, as described above, do not allow simple and reliable activation of the operating rod of the aerosol can dispensing valve for every upright position thereof. Thus, there is a need for an improved aerosol activator that is simple and reliable and can operate in numerous positions.

SUMMARY OF THE INVENTION

The present invention has the object of providing an activation device which, while having the above characteristics of a connecting nozzle ensuring activation of the aerosol can dispensing valve in the upright position, allows easy, reliable activation of the dispensing valve for any other position of the aerosol can.

This and other objects are achieved by the device according to the present invention which has a disk-shaped plate provided with a central protuberance, particularly in the shape of a dome, as described above. The device is further characterized in that the plate is disposed transversely in a cylindrical hoop attachable to an upper collar of the aerosol can, and connected at its peripheral edges to the cylindrical hoop by connecting means, such as film hinges, allowing displacement of the plate relative to said hoop attached to the aerosol can. The device also is provided with a lever mechanism, for manual activation of the device. The lever mechanism includes an activating tab projecting upward from a peripheral edge of the plate and a stop disposed above the peripheral edge of the plate in a location diametrically opposite the activating tab.

In a preferred embodiment, the device according to the invention is produced in one step, particularly by molding plastic. In such a molding step, the activating tab and the stop are made preferably diametrically opposite each other on a ring whose inside diameter is slightly less than the outside diameter of the plate. The ring is connected to the hoop by an articulated connecting part allowing the ring to be brought above the plate. Means such as cooperating latching means are also provided to attach the ring to the plate, preferably in the immediate vicinity of its peripheral edge.

The activating tab advantageously has an L-shaped section whose horizontal arm constitutes a bearing zone for the user's finger. The stop is preferably comprised of an arm of a rigid L-shaped tongue connecting the ring at the connecting part thereof to the cylindrical hoop.

BRIEF DESCRIPTION OF THE DRAWINGS

Advantages and characteristics of the invention will become apparent by reading the following description of a non-limiting embodiment with reference to the attached drawings wherein.

DETAILED DESCRIPTION OF PREFERRED EMBODIMENT

Figure 1:
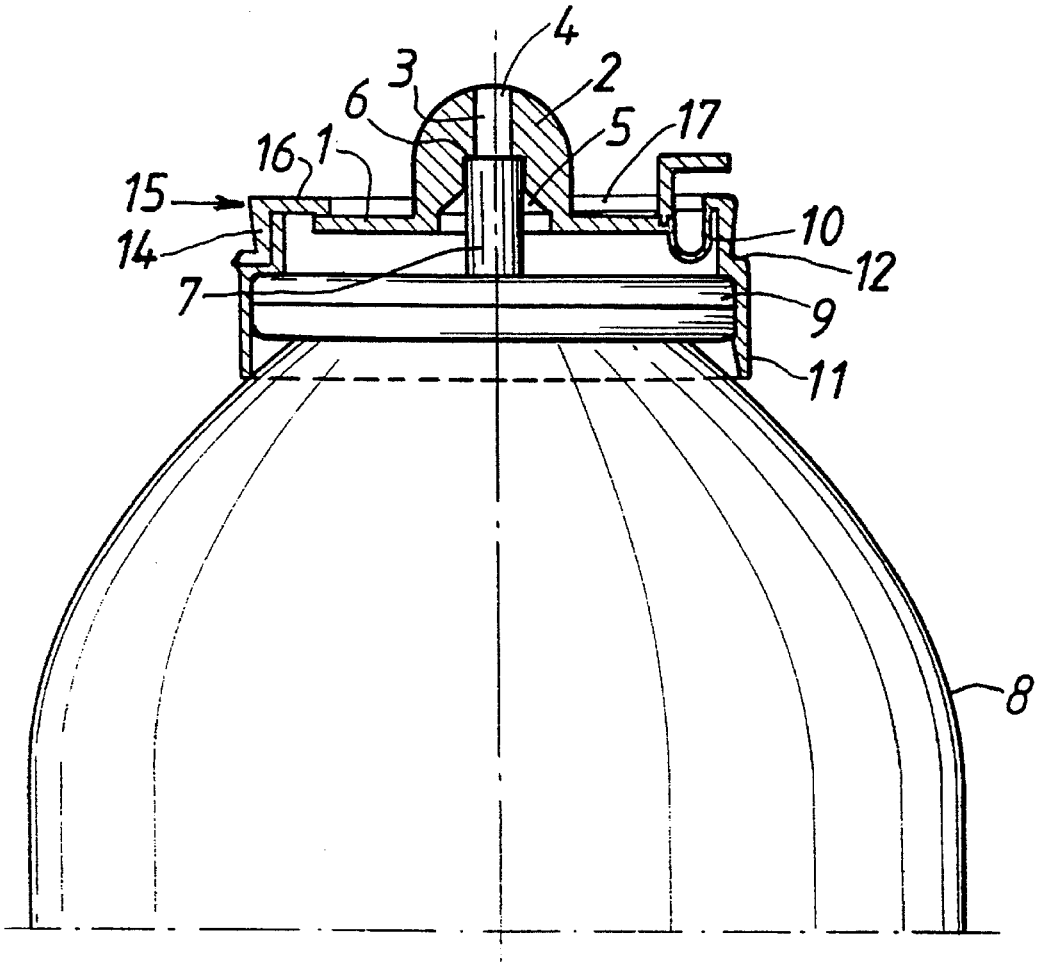
FIG. 1 illustrates a cross-sectional view of the device according to the invention mounted on an upper part of an aerosol can.
Figure 2:
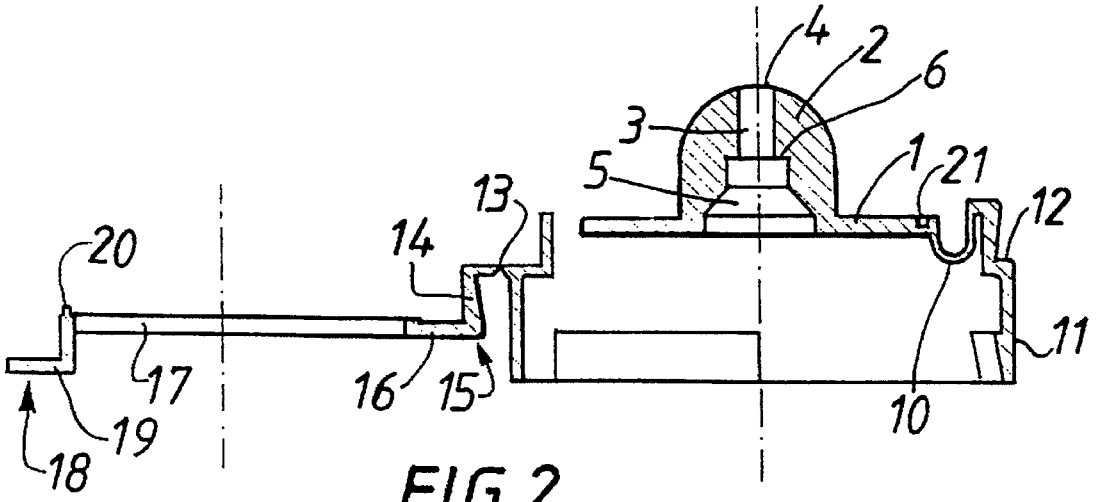
FIG. 2 is a cross-sectional view through the device according to the invention prior to mounting.
Figure 3:
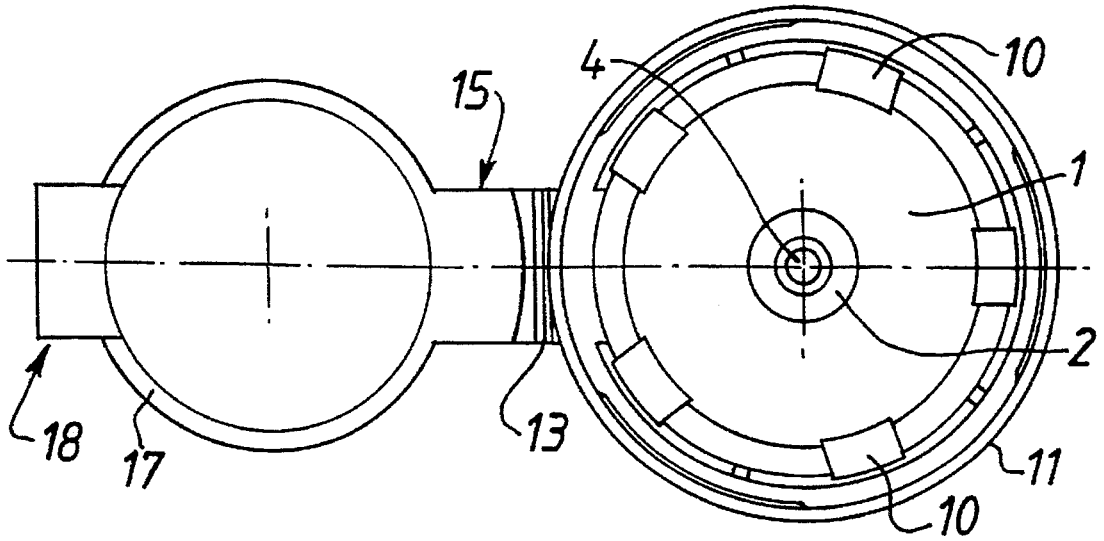
FIG. 3 is a bottom view of the device of FIG. 2.

With reference to FIGS. 1 to 3, the device according to the invention has a disk-shaped plate 1, provided centrally with a dome-shaped protuberance 2. Protuberance 2 has an internal cylindrical axial duct 3, terminating in an outlet orifice 4 at its upper part. Protuberance 2 also has an interior cavity 5 communicating with duct 3 and having a release support 6. Release support 6 is intended to constitute a stop for operating rod 7 of a dispensing valve of an aerosol can 8 provided with an upper collar 9.

Disk-shaped plate 1 is connected at its periphery by bridges of material 10, such as film hinges, to a cylindrical hoop 11 which can be integrated with collar 9 of aerosol can 8. In the example illustrated, cylindrical hoop 11 is comprised of two cylindrical skirts connected by a hoop support 12.

At its hoop support 12, cylindrical skirt 11 is connected by a zone of reduced thickness 13 to an arm 14 of an L-shaped tongue 15, whose other arm 16 is integral with a ring 17 which can be best seen in FIG. 3. Ring 17 has a slightly smaller inside diameter than the outside diameter of plate 1. Ring 17 also has, in a location diametrically opposite tongue 15, an activating tab with an L-shaped cross section, whose horizontal arm 19 constitutes, as will be explained below, a bearing surface for the finger of a user. The other arm of tab 18 has at its end a projecting nipple 20 designed to engage in a retaining orifice 21 provided in plate 1 in the vicinity of its peripheral edge.

The device according to the invention can be made in one step by molding a plastic material, particularly polypropylene. Mounting the device as shown in FIG. 2 on an aerosol can is effected by placing cylindrical skirt 11 on the upper collar 9 of aerosol can 8 until it reaches the position illustrated in FIG. 1, after which the assembly constituted by tongue 15, ring 17 and tab 18 is pivoted around the hinge constituted by reduced-thickness zone 13 up to the position illustrated in FIG. 1 wherein integration of the assembly with plate 1 is effected by engaging nipple 20 in corresponding orifice 21.

Figure 4:
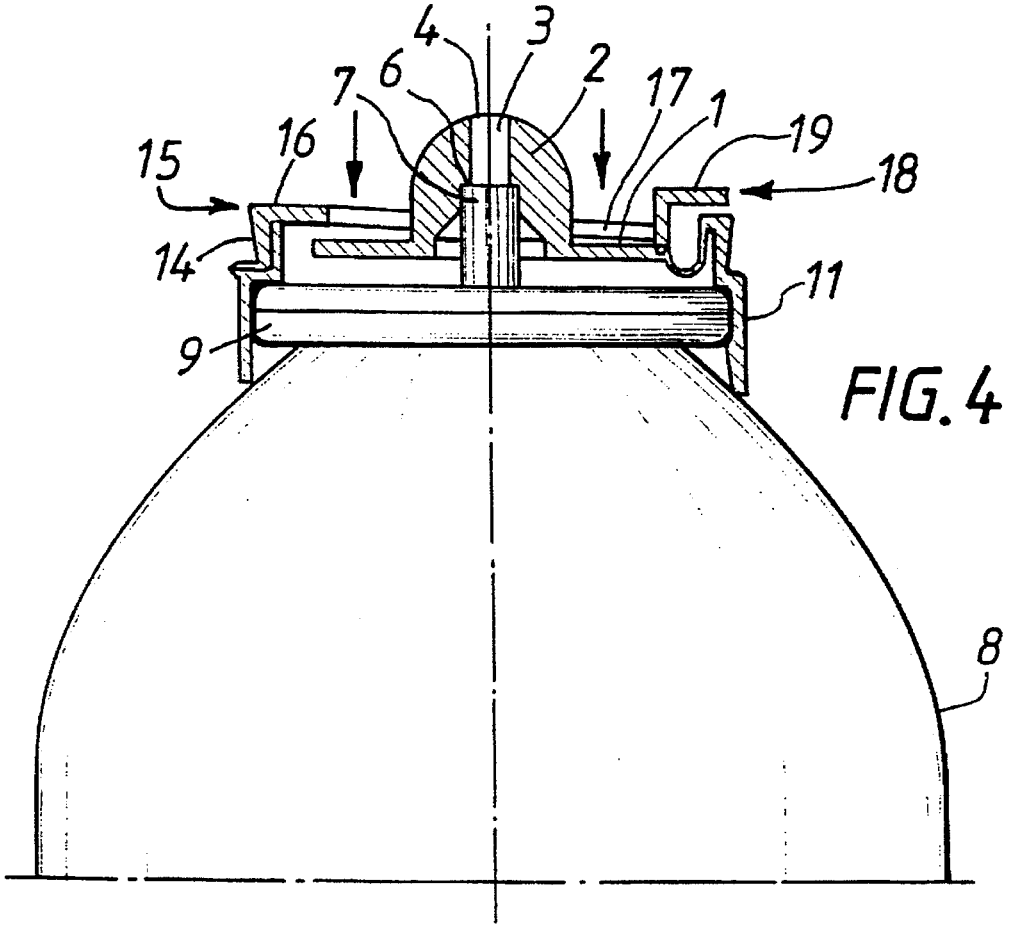
FIG. 4 is a cross-sectional view illustrating the operation of the device with the aerosol can in an upright position.
Figure 5:
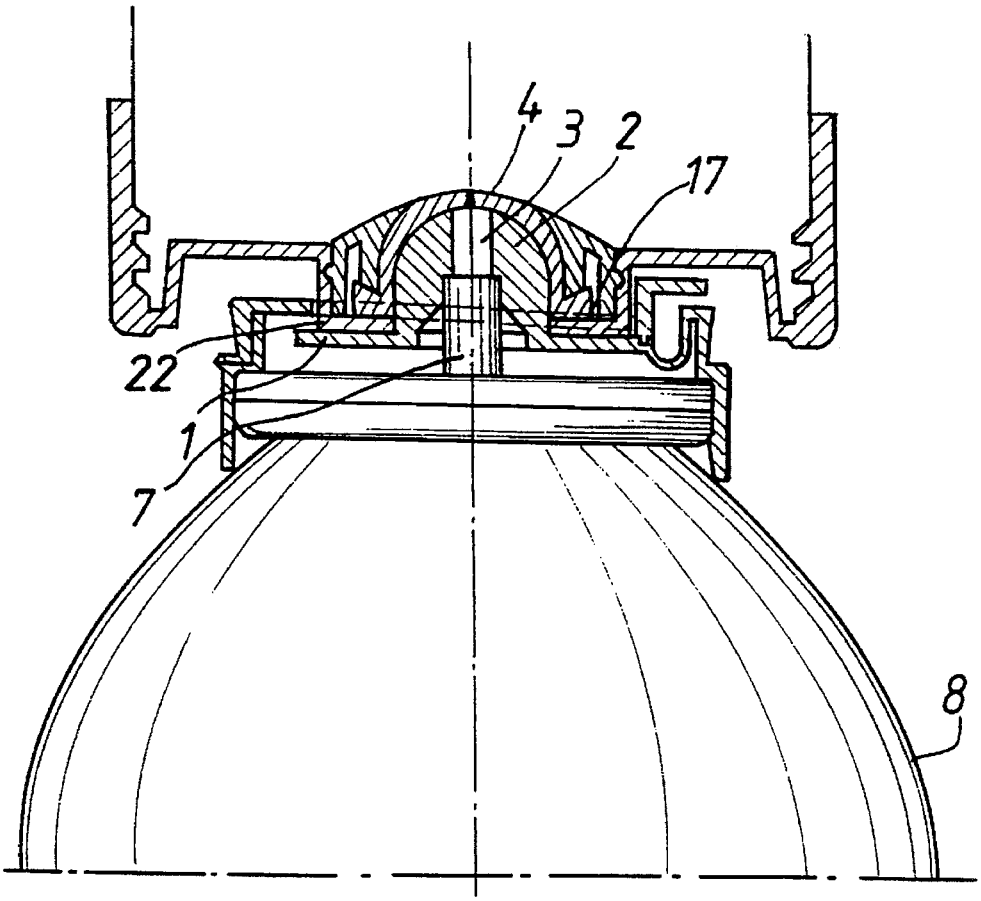
FIG. 5 is a cross-sectional view analogous to FIG. 4 showing activation of the device according to the invention in combination with a container provided with an aperture in its bottom.

Reference will now be made to FIGS. 4 and 5. When the device is to be activated in the upright position of aerosol can 8, displacement of operating rod 7 of the dispensing valve of aerosol can 8 is effected by pressing vertically on disk 1, as illustrated by the arrows of FIG. 4. This is particularly useful to fill a container, as illustrated in FIG. 5 and described in greater detail in French Patent Application 93 15442. In such use, the container is provided at a bottom extremity thereof with a cylindrical protrusion portion having an aperture centrally located therein, such as the automatically closing membrane type disclosed in French Patent Application No. 93 15442. The cylindrical protrusion portion forms an annular support 22 having a diameter sized smaller than the inner diameter of ring 17, allowing the annular support to pass through ring 17 to bear on plate 1 and activate operating rod 7. This causes contents of the aerosol can, such as dye, to enter the container through the aperture.

Figure 6:
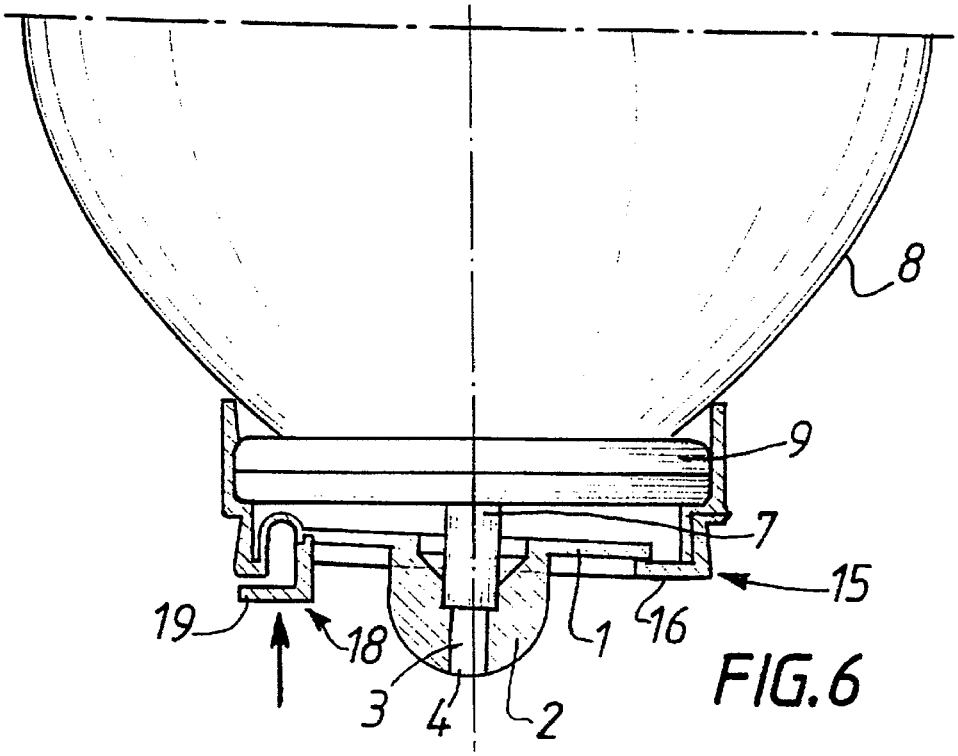
FIG. 6 is a cross-sectional view illustrating activation of the device according to the invention with the aerosol can in an inverted position.

Reference will now be made to FIG. 6. For activation of the device according to the invention in the upright position of aerosol can 8, pressure is exerted on arm 19 of tab 18 in the direction of the arrow illustrated in FIG. 6. This pressure, combined with a counter-pressure diametrically opposite by the peripheral edge of plate 1 against arm 16 of tongue 15, causes displacement, by a lever action, of plate 1 and of protuberance 2 located on it, which in turn causes slightly off-center, but nonetheless sufficient, displacement of operating rod 7 to activate the aerosol can.

The invention has been described in connection with a particular preferred embodiment, which is illustrative and not limiting. Various changes and modifications can be made without departing from the spirit and scope of the invention as defined in the appended claims.

What is claimed is:

1. An aerosol can dispensing valve activation device for an aerosol can having an upper cylindrical collar and a dispensing valve with a displaceable, hollow operating rod protruding therefrom, comprising:

a cylindrical hoop attachable to the upper cylindrical collar of the aerosol can;

a disk-shaped plate disposed transversely in said cylindrical hoop, said disk-shaped plate being provided with a central protuberance having an internal cylindrical axial duct terminating in an outlet orifice at an outer surface of said protuberance and an internal cavity communicating with said duct and having at least one release support therein, said release support constituting a release support stop for the hollow operating rod of the dispensing valve when the hollow operating rod is positioned in said internal cavity;

a peripheral edge of said plate being connected to said cylindrical hoop, allowing displacement of said plate relative to said hoop during displacement of the hollow operating rod relative to the aerosol can;

an activating lever mechanism including an activating tab projecting upward from said peripheral edge of said plate and a lever stop disposed above said peripheral edge of said plate in a location diametrically opposite said activating tab.

2. The device according to claim 1, wherein said plate has a predetermined outer diameter and said activating tab and said lever stop are diametrically opposite each other on a ring having an inside diameter slightly less than the outside diameter of said plate, said ring being connected to said hoop by an articulated connecting part that allows said ring to be positioned above said plate.

3. The device according to claim 2, wherein said plate includes a retaining orifice and said lever mechanism includes a corresponding nipple for attachment of said ring to said hoop.

4. The device according to claim 2, wherein said activating tab includes an L-shaped section having a horizontal arm that constitutes a bearing surface for a user's finger.

5. The device according to claim 2, wherein said lever stop comprises an arm having a rigid L-shaped tongue that connects said ring at said connecting part to said cylindrical hoop.

6. The device according to claim 1, wherein said protuberance is dome-shaped.

7. The device according to claim 1, wherein said plate is connected to the hoop by at least one film hinge.

8. The device according to claim 7, wherein a plurality of film hinges are spaced about said peripheral edge of said plate.

9. The device according to claim 1, wherein said device is formed as one piece from a molded plastic.

10. A combination aerosol can and dispensing valve activation device, comprising:

a first aerosol can having a dispensing valve with a displaceable, hollow operating rod protruding therefrom and an upper collar;

a second can having a bottom surface with a protruding cylindrical portion forming an annular support having a predetermined diameter and a centrally disposed aperture; and a dispensing valve activation device comprising:

a cylindrical hoop attached to said upper cylindrical collar of said first aerosol can;

a disk-shaped plate having a predetermined outer diameter disposed transversely in said cylindrical hoop, said plate being provided with a central protuberance having an internal cylindrical axial duct terminating in an outlet orifice at an outer surface of said protuberance and an internal cavity communicating with said duct and having at least one release support, said release support constituting a release support stop for the hollow operating rod of the dispensing valve when the hollow operating rod is positioned in said internal cavity;

a peripheral edge of said plate being connected to said cylindrical hoop, allowing displacement of said plate relative to said hoop;

an activating lever mechanism including an activating tab projecting upward from said peripheral edge of said plate and a lever stop, said activating tab and said lever stop being made diametrically opposite each other on a ring having an inside diameter slightly less than the outside diameter of said plate and greater than said predetermined diameter of said annular support of said second can, said annular support being positionable within said ring, said ring being connected to said hoop by an articulated connecting part that allows said ring to be positioned above said plate.

11. The device according to claim 10, wherein said plate includes a retaining orifice and said lever mechanism includes a corresponding matable nipple for attachment of said ring to said hoop.

12. The device according to claim 10, wherein said activating tab includes an L-shaped section having a horizontal arm that constitutes a bearing surface for a user's finger.

13. The device according to claim 10, wherein said lever stop comprises an arm having a rigid L-shaped tongue that connects said ring at said connecting part to said cylindrical hoop.

14. The device according to claim 10, wherein said protuberance is dome-shaped.

15. The device according to claim 10, wherein said plate is connected to said hoop by at least one film hinge.

16. The device according to claim 15, wherein a plurality of film hinges are spaced about said peripheral edge of said plate.

17. The device according to claim 10, wherein said dispensing valve activation device is formed as one piece from a molded plastic.

* * * * *